US011047260B2

(12) United States Patent
Iwai et al.

(10) Patent No.: US 11,047,260 B2
(45) Date of Patent: Jun. 29, 2021

(54) TURBINE CASING

(71) Applicant: TOSHIBA ENERGY SYSTEMS & SOLUTIONS CORPORATION, Kawasaki (JP)

(72) Inventors: Shogo Iwai, Ota (JP); Tsuguhisa Tashima, Yokohama (JP); Toshio Morimoto, Yokohama (JP)

(73) Assignee: TOSHIBA ENERGY SYSTEMS & SOLUTIONS CORPORATION, Kawasaki (JP)

( * ) Notice: Subject to any disclaimer, the term of this patent is extended or adjusted under 35 U.S.C. 154(b) by 0 days.

(21) Appl. No.: 16/713,068

(22) Filed: Dec. 13, 2019

(65) Prior Publication Data

US 2020/0191015 A1 Jun. 18, 2020

(30) Foreign Application Priority Data

Dec. 17, 2018 (JP) ..... JP2018-235131

(51) Int. Cl.
*F01D 25/14* (2006.01)
*F01D 25/12* (2006.01)
*F01D 25/24* (2006.01)

(52) U.S. Cl.
CPC ..... *F01D 25/14* (2013.01); *F01D 25/12* (2013.01); *F01D 25/243* (2013.01); *F05D 2220/30* (2013.01)

(58) Field of Classification Search
CPC ..... F01D 25/14; F01D 25/12; F01D 25/243; F01D 25/30; F01D 25/26; F05D 2220/30; F05D 2250/52; F05D 2300/171; F05D 2210/12
USPC ..... 415/213.1, 214.1, 220, 224.5
See application file for complete search history.

(56) References Cited

U.S. PATENT DOCUMENTS

| | | | | |
|---|---|---|---|---|
| 3,190,612 | A * | 6/1965 | Conrad, Sr. | F01D 9/06 415/134 |
| 4,642,025 | A * | 2/1987 | Heiniger | F01D 9/06 415/139 |
| 6,302,644 | B1 * | 10/2001 | Kukalj | F01D 25/24 415/150 |
| 2014/0023478 | A1 * | 1/2014 | Maeda | F01D 25/26 415/1 |
| 2015/0121898 | A1 | 5/2015 | Tashima et al. | |
| 2018/0238194 | A1 * | 8/2018 | Tejima | F01D 25/14 |

FOREIGN PATENT DOCUMENTS

| | | | |
|---|---|---|---|
| JP | 5917324 | B2 | 5/2016 |
| JP | 6013288 | B2 | 10/2016 |
| WO | WO 2017/068616 | A1 | 4/2017 |

* cited by examiner

*Primary Examiner* — Hoang M Nguyen
(74) *Attorney, Agent, or Firm* — Oblon, McClelland, Maier & Neustadt, L.L.P.

(57) ABSTRACT

There is provided a turbine casing capable of easily realizing improvement of reliability regarding a connection with an exhaust pipe. A turbine casing according to an embodiment includes an exhaust pipe connecting part formed of ferritic heat resistant steel, to which an exhaust pipe formed of austenitic heat resistant steel is connected. Here, the exhaust pipe connecting part and the exhaust pipe are fastened by using screws.

5 Claims, 5 Drawing Sheets

TURBINE CASING

CROSS REFERENCE TO RELATED APPLICATIONS

This application is based upon and claims the benefit of priority from the prior Japanese Patent Application (No. 2018-235131), filed on Dec. 17, 2018; the entire contents of which are incorporated herein by reference.

FIELD

Embodiments of the present invention relate to a turbine casing.

BACKGROUND

A supercritical $CO_2$ power generation system is a power generation system which uses a working fluid containing carbon dioxide ($CO_2$) in a supercritical state as a main component, and is attracting attention because of concern for the environment. This power generation system can collect supercritical $CO_2$ generated during power generation as needed, and can dramatically decrease $CO_2$ which is released into the atmosphere by using CCS (Carbon dioxide Capture and Storage) and CCU (Carbon dioxide Capture and Utilization) in a combined manner.

One example of a structure of a supercritical $CO_2$ turbine 10 configuring a supercritical $CO_2$ power generation system will be described by using FIG. 5. FIG. 5 illustrates a partial cross section of a vertical plane (xz plane), in which a longitudinal direction indicates a vertical direction z, a lateral direction indicates a first horizontal direction x, and a direction orthogonal to the paper surface indicates a second horizontal direction y. Further, in FIG. 5, flows of working media F1, F2, F3 are indicated by arrow marks of heavy solid lines, the left side indicates an upstream side Us, and the right side indicates a downstream side Ds. Besides, in FIG. 5, flows of cooling media CF1, CF2, CF3, CF4 are indicated by arrow marks of heavy broken lines.

As illustrated in FIG. 5, the supercritical $CO_2$ turbine 10 includes a turbine casing 20 and a turbine rotor 40, and is configured such that when the working medium F1 containing carbon dioxide ($CO_2$) in a supercritical state as a main component is supplied thereto, the turbine rotor 40 is rotated inside the turbine casing 20. Here, the supercritical $CO_2$ turbine 10 is a multistage axial flow turbine, and plural turbine stages 60 are arranged in an axial direction along a rotation center axis AX of the turbine rotor 40 (the first horizontal direction x).

Concrete contents of respective parts configuring the supercritical $CO_2$ turbine 10 will be described in order.

The turbine casing 20 has an inner casing 21 and an outer casing 22, and has a double structure in which the inner casing 21 is housed inside the outer casing 22.

The turbine casing 20 includes a first inner casing 211, a second inner casing 212, and a third inner casing 213 as the inner casing 21, and the first inner casing 211, the second inner casing 212, and the third inner casing 213 are arranged in order from the upstream side Us toward the downstream side Ds.

A gland part 23 is provided to an inner peripheral surface of the turbine casing 20. The gland part 23 includes a first packing head 231 and a second packing head 232. The first packing head 231 is provided to an inner peripheral surface of the third inner casing 213. The second packing head 232 is provided to an inner peripheral surface of the outer casing 22, at an end part on a side where the third inner casing 213 is positioned. An axial seal member 233 is provided between the first packing head 231 and the second packing head 232.

Further, to inner peripheral surfaces of the respective outer casing 22, first inner casing 211, first packing head 231, and second packing head 232, packing rings 24 are provided. The packing ring 24 has a fin, and is disposed to suppress leakage by narrowing a gap interposed between the packing ring 24 and the turbine rotor 40.

An annular exhaust hood S213 is interposed between the third inner casing 213 and the first packing head 231. A diffuser 25 is provided inside the exhaust hood S213. The diffuser 25 is fixed to the second inner casing 212. Further, a radial seal member 251 is provided between the third inner casing 213 and the diffuser 25.

The turbine rotor 40 is a column-shaped bar body, and is housed inside the turbine casing 20 so that the rotation center axis AX extends in the first horizontal direction x. The turbine rotor 40 is coupled to a power generator (whose illustration is omitted), and when the turbine rotor 40 is rotated, the power generator (whose illustration is omitted) is driven to generate power.

The turbine stage 60 includes a stationary blade 61 and a rotor blade 62.

The stationary blades 61 are disposed at each of an inner peripheral surface of the first inner casing 211 and an inner peripheral surface of the second inner casing 212 in the inner casing 21. The stationary blades 61 are arranged in plural numbers in a rotational direction R (circumferential direction) of the turbine rotor 40, and the plural stationary blades 61 configure a stationary blade cascade. The stationary blade cascades are provided in plural stages, and the plural stages of stationary blade cascades are arranged along the axial direction (x) along the rotation center axis AX of the turbine rotor 40.

The rotor blades 62 are arranged in plural numbers in the rotational direction R of the turbine rotor 40, and the plural rotor blades 62 configure a rotor blade cascade. Similarly to the stationary blade cascades, the rotor blade cascades are provided in plural stages, and the plural stages of rotor blade cascades are arranged along the axial direction (x) along the rotation center axis AX of the turbine rotor 40. Specifically, the stationary blade cascade and the rotor blade cascade are alternately arranged along the axial direction (x).

In the supercritical $CO_2$ turbine 10, a combustor casing 80 configuring a combustor (whose illustration is omitted) is joined to an inlet part of the outer casing 22 by using bolts 81.

Further, the supercritical $CO_2$ turbine 10 is provided with an inlet guide pipe 801. The inlet guide pipe 801 has one end coupled to the combustor (whose illustration is omitted) and the other end coupled to the turbine stage 60 of an initial stage. The inlet guide pipe 801 is disposed so as to penetrate the inside of the combustor casing 80 and penetrate the inside of a through hole formed on the inlet part of the outer casing 22 and the inside of a through hole formed on the first inner casing 211. Here, an inlet sleeve 802 is provided to the through hole formed on the inlet part of the outer casing 22 and the through hole formed on the first inner casing 211, and the inlet guide pipe 801 penetrates the inside of the inlet sleeve 802.

In the supercritical $CO_2$ turbine 10, an exhaust pipe 90 is joined, via a welded portion 91, to a pipe barrel part 22*a* provided to an outlet part of the outer casing 22. One end of the exhaust pipe 90 is joined to the outer casing 22, and the other end thereof positioned on the opposite side of the one end is joined to an on-site pipe 93 via a welded portion 92.

Further, the supercritical $CO_2$ turbine 10 is provided with an outlet sleeve 901. The outlet sleeve 901 penetrates the pipe barrel part 22*a* of the outer casing 22, one end thereof is coupled to a pipe barrel part 213*a* of the third inner casing 213, and the other end thereof is coupled to the exhaust pipe 90.

Hereinafter, operations in which the working media F1, F2, F3 flow, and operations in which the cooling media CF1, CF2, CF3, CF4 flow in the above-described supercritical $CO_2$ turbine 10 will be described in order.

In the supercritical $CO_2$ turbine 10, the working medium F1 is a medium containing carbon dioxide ($CO_2$) in a supercritical state as a main component, and is introduced into the turbine stages 60 from the combustor (whose illustration is omitted) via the inlet guide pipe 801. Subsequently, the working medium F1 flows in the axial direction along the rotation center axis AX, to thereby perform work in each of the plural turbine stages 60. Further, the working medium F2 flowed through the final stage of the turbine stages 60 is discharged to the exhaust hood S213. After that, the working medium F3 is discharged from the exhaust hood S213 to the on-site pipe 93 via the outlet sleeve 901 and the exhaust pipe 90.

In the supercritical $CO_2$ turbine 10, the cooling medium CF1 is, for example, carbon dioxide, and is a medium whose temperature is lower than that of the working medium F1. The cooling medium CF1 is introduced into a flow path provided between an inner peripheral surface of the combustor casing 80 and an outer peripheral surface of the inlet guide pipe 801. Subsequently, the cooling medium CF1 flows through a flow path provided between an inner peripheral surface of the inlet sleeve 802 and the outer peripheral surface of the inlet guide pipe 801. Further, although the illustration is omitted, the cooling medium CF1 is introduced into holes provided to each of the stationary blades 61 and the rotor blades 62, and after cooling the stationary blades 61, the rotor blades 62, and the turbine rotor 40, for example, it is discharged to the outside of the supercritical $CO_2$ turbine 10 via a discharge port (whose illustration is omitted) or mixed to the flow of the working medium F1 or the cooling medium CF2.

Other than the above, in the supercritical $CO_2$ turbine 10, the cooling medium CF2 flows through a space interposed between the third inner casing 213 and the outer casing 22. This cooling medium CF2 is, for example, carbon dioxide, and is a medium whose temperature is lower than that of the working medium F2. Further, the cooling medium CF2 is introduced from a conduit (whose illustration is omitted) communicated with a space interposed between the third inner casing 213 and the outer casing 22. This makes it possible to prevent a temperature of the outer casing 22 from increasing due to heat caused by convection or radiation.

After that, the cooling medium CF3 flows through a flow path positioned between an inner peripheral surface of the pipe barrel part 22*a* provided to the outlet part of the outer casing 22 and an outer peripheral surface of the outlet sleeve 901. This makes it possible to prevent a temperature of the outer casing 22 from increasing due to heat caused by convection or radiation. Further, after the cooling medium CF4 flows through a flow path positioned between an inner peripheral surface of the exhaust pipe 90 and the outer peripheral surface of the outlet sleeve 901, for example, the cooling medium CF4 is discharged to the outside of the supercritical $CO_2$ turbine 10 via a discharge port (whose illustration is omitted) formed on the exhaust pipe 90.

Note that it is also possible that a cooling medium (whose illustration is omitted) is introduced from the outside into the flow path positioned between the inner peripheral surface of the pipe barrel part 22*a* provided to the outlet part of the outer casing 22 and the outer peripheral surface of the outlet sleeve 901.

Hereinafter, materials and so on used in the above-described supercritical $CO_2$ turbine 10 will be described.

In the turbine casing 20, the outer casing 22 is required to be thick in order to obtain large strength, by considering an inside pressure. Further, the outer casing 22 has a large size. For this reason, the outer casing 22 is generally manufactured by casting.

In the supercritical $CO_2$ turbine 10, the working medium F1 introduced into an inlet at which it is supplied from the combustor, has a temperature of 800° C. or more and a pressure of 20 MPa or more. Further, the working medium F3 discharged from the outlet of the outer casing 22 has a temperature of 650° C. or more and a pressure of 2 MPa or more. In order to obtain high strength and excellent oxidation resistance at a temperature of 650° C. or more, it can be considered to form respective parts by using, not ferritic heat resistant steel, but austenitic heat resistant steel such as a Ni-based alloy.

However, when manufacturing a large-sized casting by using the austenitic heat resistant steel such as the Ni-based alloy, it is highly possible that a casting defect occurs, and besides, problems regarding segregation and anisotropy of a metal structure arise in some cases. In this case, since it becomes difficult to perform an internal defect inspection due to enlargement of crystal grains, it is not easy to secure a product quality. Depending on materials, it is sometimes technically impossible to perform manufacture. Besides, a unit price of the material is expensive. When these points are taken into consideration, it is not realistic to form the entire outer casing 22 by using the austenitic heat resistant steel such as the Ni-based alloy.

Based on the circumstances as described above, in the above-described supercritical $CO_2$ turbine 10, the outer casing 22 is manufactured through casting by using the ferritic heat resistant steel. Further, parts which are directly brought into contact with exhaust air of high temperature (the third inner casing 213, the first packing head 231, the outlet sleeve 901, the exhaust pipe 90, the diffuser 25) are manufactured through casting by using the austenitic heat resistant steel such as the Ni-based alloy. Further, as described above, in order to prevent the temperature of the outer casing 22 from being a temperature exceeding a heatproof temperature, cooling is performed by using the cooling media CF1, CF2, CF3, CF4.

As described above, in the supercritical $CO_2$ turbine 10, the exhaust pipe 90 is joined, via the welded portion 91, to the pipe barrel part 22*a* (exhaust pipe connecting part) provided to the outlet part of the outer casing 22. The pipe barrel part 22*a* (exhaust pipe connecting part) of the outer casing 22 is formed of the ferritic heat resistant steel. On the contrary, the exhaust pipe 90 is formed of the austenitic heat resistant steel such as the Ni-based alloy. For this reason, the following problems may arise.

Concretely, chemical components are greatly different between the ferritic heat resistant steel and the austenitic heat resistant steel, so that when the both steels are joined by welding, there is a case where a structural stability at a boundary surface is not maintained over a long period of time.

Since a linear expansion coefficient of the ferritic heat resistant steel and a linear expansion coefficient of the austenitic heat resistant steel are different, when the both steels are joined by welding, a large residual stress is generated in some cases. As a result of this, there is a case where a crack occurs in the welded portion 91 at which different materials are welded, or in the vicinity of the welded portion 91.

The ferritic heat resistant steel and the austenitic heat resistant steel have different material strengths, and have different temperature ranges in which a structure has a stable state. For this reason, it is not easy to precisely set temperature conditions in heat treatment to be performed after welding (PWHT: Post Weld Heat Treatment). Consequently, there is a case where removal of the residual stress becomes insufficient. Further, the structure changes in some cases in the vicinity of the welded portion 91 at which the different materials are welded.

It is not easy to perform an internal defect inspection with respect to the welded portion 91 at which the different materials are welded. Further, there is a need to carry out a welding procedure test and a material evaluation test before performing manufacture by welding of different materials. As a result of this, an increase in manufacturing cost, an increase in length of time taken for the manufacture, and so on occur.

In particular, when the temperature and the pressure of the working medium are increased to realize high efficiency of the power generation system, it becomes necessary to use the Ni-based alloy as the austenitic heat resistant steel. Consequently, it becomes further difficult to perform welding of different materials.

Based on such circumstances, in the above-described supercritical $CO_2$ turbine 10, it is not easy to sufficiently improve reliability regarding the connection between the pipe barrel part 22*a* (exhaust pipe connecting part) provided to the outlet part of the outer casing 22 and the exhaust pipe 90.

Also in each of turbines other than the supercritical $CO_2$ turbine 10 (a steam turbine, a gas turbine, a medium turbine, and so on), reliability regarding a connection with an exhaust pipe becomes insufficient in some cases, similarly to the above.

Therefore, the problem to be solved by the present invention is to provide a turbine casing capable of easily realizing improvement of reliability regarding a connection with an exhaust pipe.

DETAILED DESCRIPTION

A turbine casing according to an embodiment includes an exhaust pipe connecting part formed of ferritic heat resistant steel, to which an exhaust pipe formed of austenitic heat resistant steel is connected. Here, the exhaust pipe connecting part and the exhaust pipe are fastened by using screws.

First Embodiment

Figure 1:
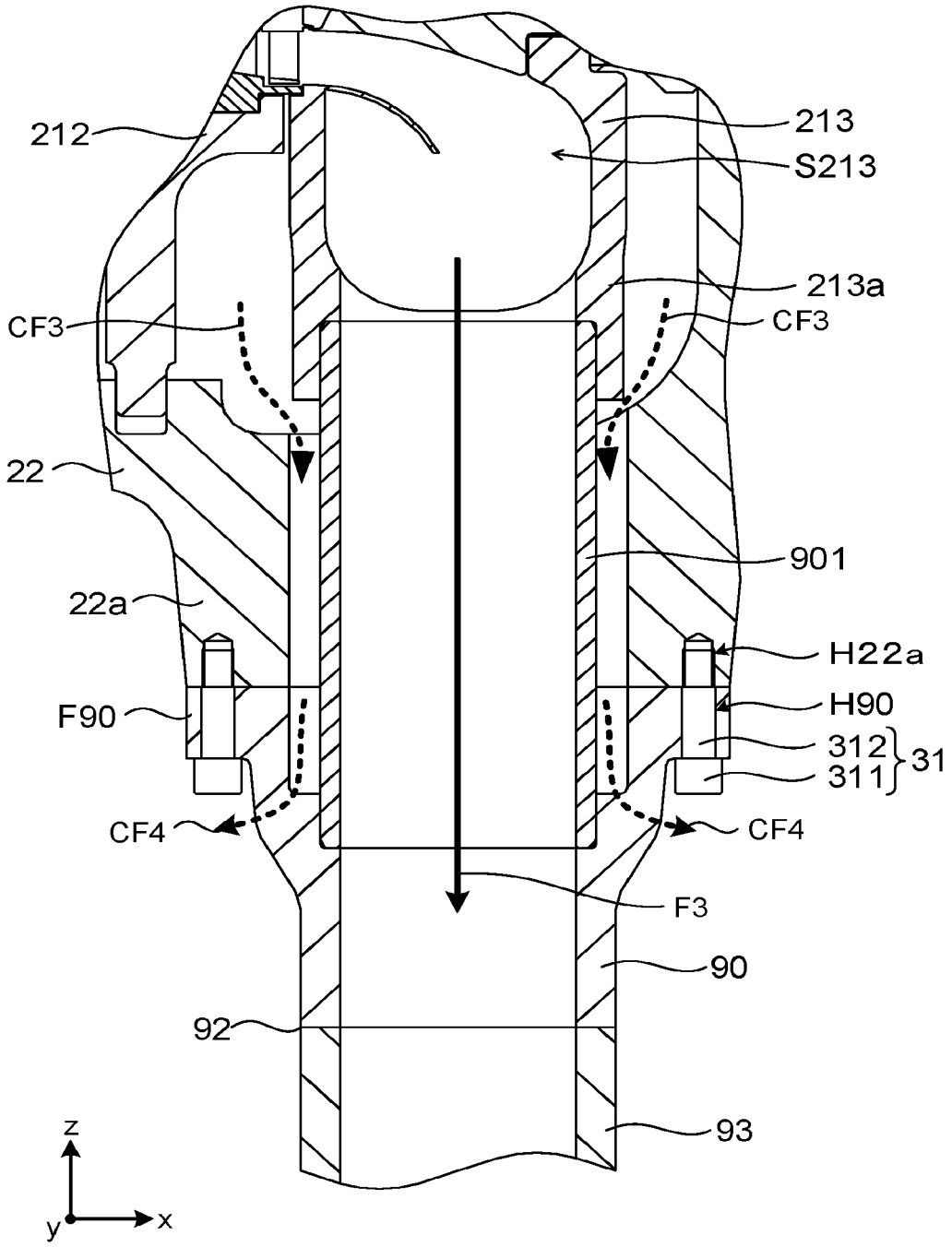
FIG. 1 is a view illustrating a substantial part of a turbine according to a first embodiment.

A supercritical $CO_2$ turbine 10 according to a first embodiment will be described by using FIG. 1. FIG. 1 illustrates a cross section of a vertical plane (xz plane), similarly to FIG. 5, and illustrates a part of the cross section in an enlarged manner.

Figure 5:
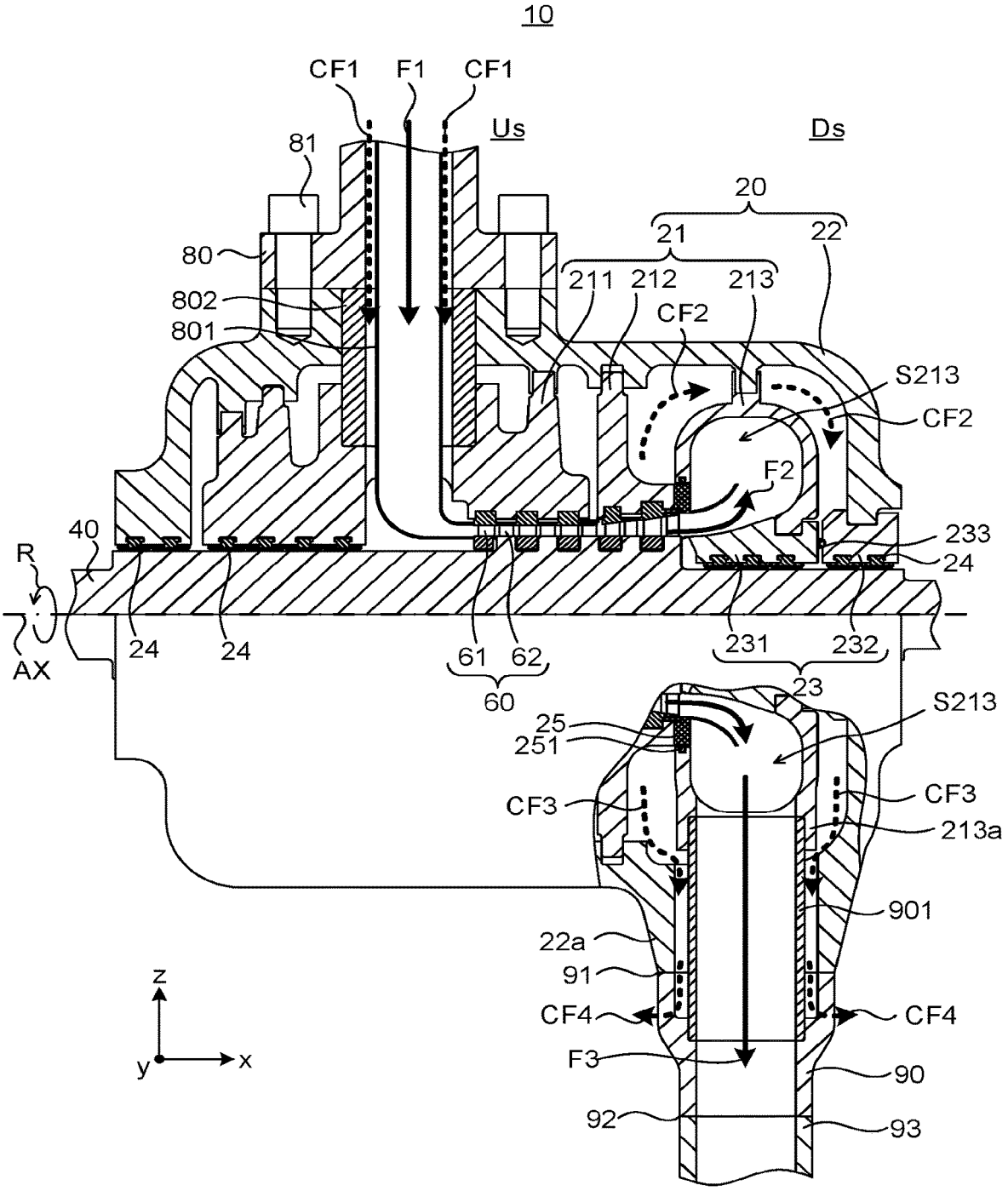
FIG.5 Related Art
FIG. 5 is a view illustrating a substantial part of a turbine according to a related art.

As illustrated in FIG. 1, in the present embodiment, an exhaust pipe 90 formed of austenitic heat resistant steel is connected to a pipe barrel part 22*a* (exhaust pipe connecting part) of an outer casing 22 formed of ferritic heat resistant steel in a turbine casing 20 (refer to FIG. 5). Further, an outlet sleeve 901 formed of the austenitic heat resistant steel is disposed so as to penetrate the pipe barrel part 22*a* of the outer casing 22. One end (upper end in FIG. 1) of the outlet sleeve 901 is coupled to a pipe barrel part 213*a* of a third inner casing 213 formed of the austenitic heat resistant steel. Further, the other end (lower end in FIG. 1) of the outlet sleeve 901 is coupled to the exhaust pipe 90. Other than the above, in the present embodiment, a cooling medium CF3 flows through a space interposed between the outer casing 22 and the third inner casing 213, and a cooling medium CF4 flows through a space interposed between the exhaust pipe 90 and the outlet sleeve 901.

However, in the present embodiment, the state where the exhaust pipe 90 is connected to the pipe barrel part 22*a* of the outer casing 22 is different from that of the above-described related art (refer to FIG. 5). Except this point and a point related to this, the present embodiment is similar to the case of the above-described related art. For this reason, explanation of overlapped matters will be appropriately omitted.

In the present embodiment, the exhaust pipe 90 and the pipe barrel part 22*a* of the outer casing 22 are fastened by using bolts 31 (male screw components) being screws.

Concretely, in the present embodiment, a flange F90 is formed on the exhaust pipe 90. In the flange F90 of the exhaust pipe 90, insertion holes H90 into which the bolts 31 are to be inserted are formed. Further, in the pipe barrel part 22*a* of the outer casing 22, holes H22*a* formed with female screw portions are formed.

Each of the bolts 31 includes a head portion 311 and a shaft portion 312 formed with a male screw portion, the shaft portion 312 is inserted into the insertion hole H90 formed in the flange F90 of the exhaust pipe 90, and is attached to the hole H22*a* formed with the female screw portion in the pipe barrel part 22*a* of the outer casing 22. Consequently, the exhaust pipe 90 is fixed to the outer casing 22. The bolt 31 is formed of the austenitic heat resistant steel such as the Ni-based alloy, for example. Other than the above, it is also possible to use the bolt 31 formed of a high Cr-based material in accordance with a temperature.

As described above, in the present embodiment, the exhaust pipe 90 formed of the austenitic heat resistant steel and the pipe barrel part 22*a* (exhaust pipe connecting part) of the outer casing 22 formed of the ferritic heat resistant steel are fastened by using the bolts 31 being the screws. For this reason, in the present embodiment, it is possible to connect the exhaust pipe 90 and the pipe barrel part 22*a* of the outer casing 22 more easily when compared to the case of connecting them by welding.

Further, in the present embodiment, it becomes unnecessary to perform the internal defect inspection and the like regarding the welded portion 91 at which different materials are welded (refer to FIG. 1), so that it is possible to greatly reduce a period of time for the manufacture. Further, in the present embodiment, the exhaust pipe 90 and the pipe barrel part 22*a* of the outer casing 22 are in a state of being physically separated, so that the reduction in structural stability does not occur, unlike the case of joining them by welding. As a result of this, in the present embodiment, it is possible to improve the reliability over a long period of time.

Note that although the above-described embodiment describes the case where the shaft portion 312 of the bolt 31 is attached to the hole H22*a* formed with the female screw portion in the pipe barrel part 22*a* of the outer casing 22, the embodiment is not limited to this. Although the illustration is omitted, it is also possible that, for example, a tap-end stud having no head portion and including a shaft portion having male screw portions formed on one end side and the other end side thereof, is inserted from the one end side into the insertion hole H90 and the hole H22*a* to be attached, and then a nut is attached to the other end side, to thereby perform fastening.

Second Embodiment

Figure 2:
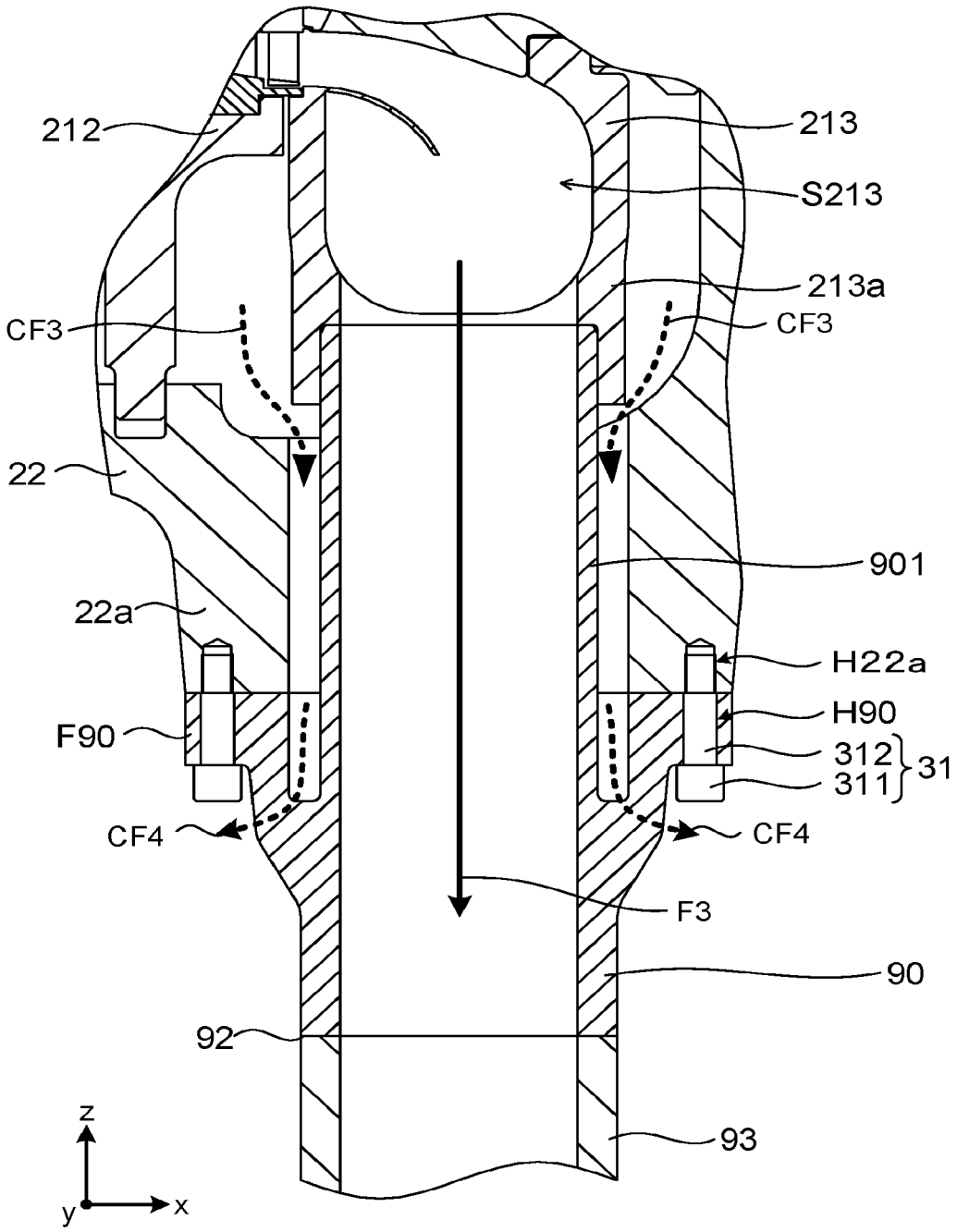
FIG. 2 is a view illustrating a substantial part of a turbine according to a second embodiment.

A supercritical $CO_2$ turbine 10 according to a second embodiment will be described by using FIG. 2. FIG. 2 illustrates a partial cross section of a vertical plane (xz plane), similarly to FIG. 1.

As illustrated in FIG. 2, in the present embodiment, the configuration of the exhaust pipe 90 and the outlet sleeve 901 (refer to FIG. 1) is different from that of the above-described first embodiment (refer to FIG. 1). Except this point and a point related to this, the present embodiment is similar to the case of the first embodiment. For this reason, explanation of overlapped matters will be appropriately omitted.

In the present embodiment, the exhaust pipe 90 and the outlet sleeve 901 are integrally formed, unlike the case of the first embodiment (refer to FIG. 1). For example, the exhaust pipe 90 and the outlet sleeve 901 are in a state of being joined to each other by welding, and in a state where they cannot be separated from each other. Other than the above, it is also possible that the exhaust pipe 90 and the outlet sleeve 901 are formed by monoblock casting.

As described above, in the present embodiment, by the integration of the exhaust pipe 90 and the outlet sleeve 901 (refer to FIG. 1), the number of components is reduced, and the structure is simplified. Along with this, in the present embodiment, it is possible to prevent the cooling medium CF3 which flows through the space interposed between the exhaust pipe 90 and the outlet sleeve 901 (refer to FIG. 1) from being leaked to the inside from a gap between the exhaust pipe 90 and the outlet sleeve 901 (refer to FIG. 1). Further, it is possible to prevent the working medium F3 which flows through the inside of the outlet sleeve 901 (refer to FIG. 1) from being passed through the space interposed between the exhaust pipe 90 and the outlet sleeve 901 (refer to FIG. 1) to be mixed to the flow of the cooling medium CF4. As a result of this, in the present embodiment, it is possible to effectively cool the pipe barrel part 22*a* of the outer casing 22, so that the reliability can be further improved.

Third Embodiment

Figure 3:
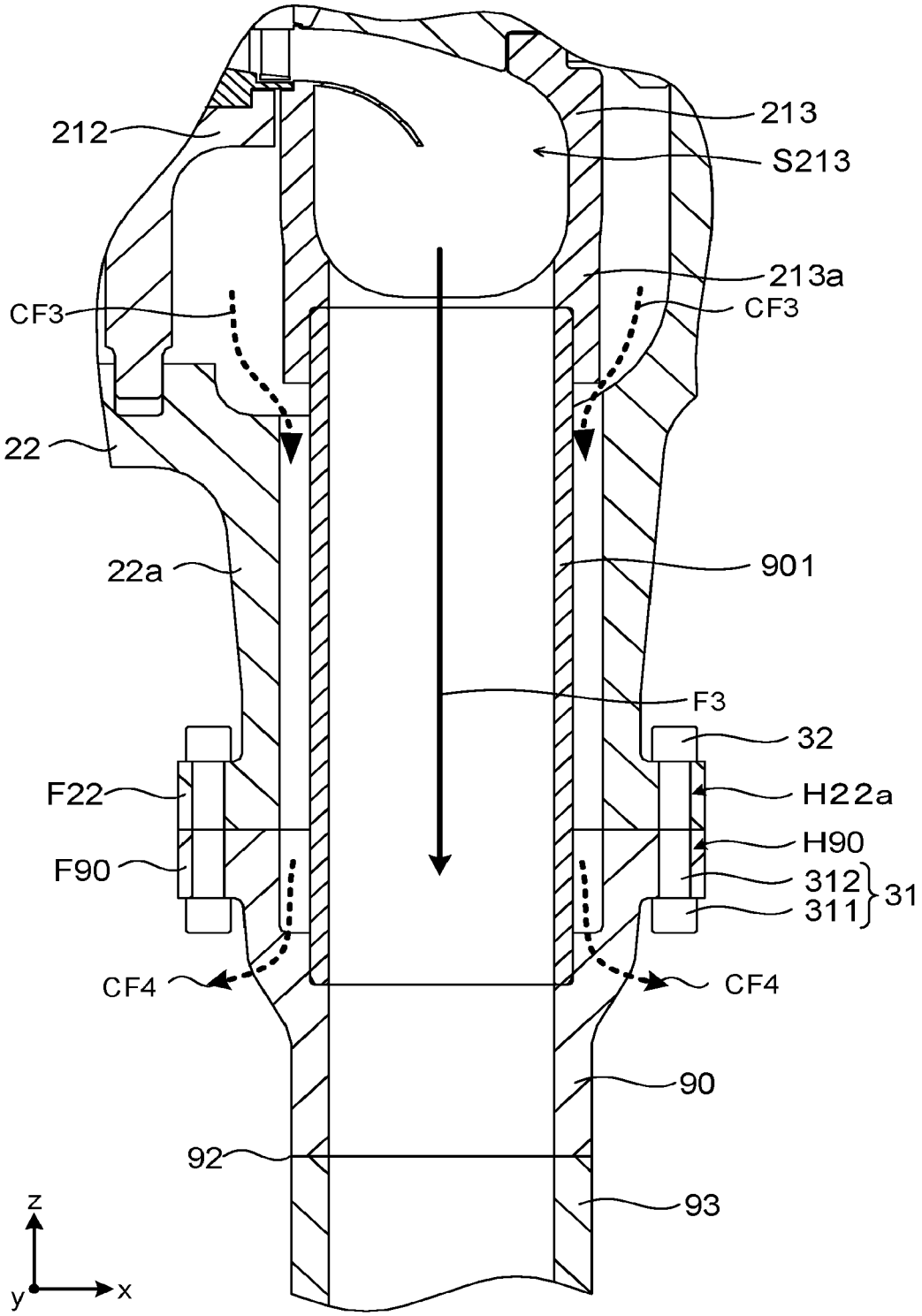
FIG. 3 is a view illustrating a substantial part of a turbine according to a third embodiment.

A supercritical $CO_2$ turbine 10 according to a third embodiment will be described by using FIG. 3. FIG. 3 illustrates a partial cross section of a vertical plane (xz plane), similarly to FIG. 1.

As illustrated in FIG. 3, in the present embodiment, the state where the exhaust pipe 90 is connected to the pipe barrel part 22*a* of the outer casing 22 is different from that of the above-described first embodiment (refer to FIG. 1). Except this point and a point related to this, the present embodiment is similar to the case of the first embodiment. For this reason, explanation of overlapped matters will be appropriately omitted.

In the present embodiment, the exhaust pipe 90 and the pipe barrel part 22*a* of the outer casing 22 are fastened by using bolts 31 (male screw components) and nuts 32 (female screw components).

Concretely, in the present embodiment, the flange F90 is formed on the exhaust pipe 90. In the flange F90 of the exhaust pipe 90, the insertion holes H90 into which the bolts 31 are to be inserted are formed.

In the present embodiment, a flange F22 is formed also on the pipe barrel part 22*a* of the outer casing 22. In the flange F22 formed on the pipe barrel part 22*a* of the outer casing 22, insertion holes H22 into which the bolts 31 are to be inserted are formed.

Each of the bolts 31 includes a head portion 311 and a shaft portion 312 formed with a male screw, and the shaft portion 312 of the bolt 31 is sequentially inserted into the insertion hole H90 formed in the flange F90 of the exhaust pipe 90 and the insertion hole H22 formed in the flange F22 of the pipe barrel part 22*a*. Subsequently, the nut 32 formed with a female screw portion is attached to the shaft portion 312 formed with the male screw of the bolt 31. Consequently, the exhaust pipe 90 is fixed to the outer casing 22.

The bolt 31 and the nut 32 are formed of the austenitic heat resistant steel such as the Ni-based alloy or the high Cr-based heat resistant steel, for example. The pipe barrel part 22*a* of the outer casing 22 is formed of the ferritic heat resistant steel. When there is a difference in linear expansion coefficient or a temperature difference between the bolt 31 and the pipe barrel part 22*a* of the outer casing 22, an expansion difference is generated. As in the case of the first embodiment, when the female screw portion is formed on the pipe barrel part 22*a*, there is a risk that the fastening is performed excessively to damage the female screw portion formed on the pipe barrel part 22*a* of the outer casing 22, due to this expansion difference.

However, in the present embodiment, the female screw portion is not formed on the pipe barrel part 22*a* of the outer casing 22. As a result of this, if the female screw portion formed on the pipe barrel part 22*a* of the outer casing 22 is damaged in the case of the first embodiment, it is not easy to perform maintenance, but, in the present embodiment, since the female screw portion is not formed on the pipe barrel part 22*a* of the outer casing 22, it is possible to easily carry out maintenance only by exchanging the bolt 31 and the nut 32.

Therefore, in the present embodiment, the fastening between the exhaust pipe 90 and the outer casing 22 can be performed sufficiently, so that it is possible to further improve the reliability over a long period of time.

Note that although the above-described embodiment describes the case where the bolt 31 includes the head portion 311 and the shaft portion 312 formed with the male screw, the embodiment is not limited to this. The bolt 31 may also be a double-ended bolt (stud bolt) having no head portion and having male screws formed on respective both ends of a shaft portion thereof. In this case, fastening is performed by attaching nuts to the respective both ends of the double-ended bolt.

Further, although the above-described embodiment describes the case where the bolt 31 is provided on the exhaust pipe 90 side, and the nut 32 is provided on the outer casing 22 side, the embodiment is not limited to this. It is also possible to design such that the bolt 31 is provided on the outer casing 22 side, and the nut 32 is provided on the exhaust pipe 90 side.

<Others>

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

Figure 4:
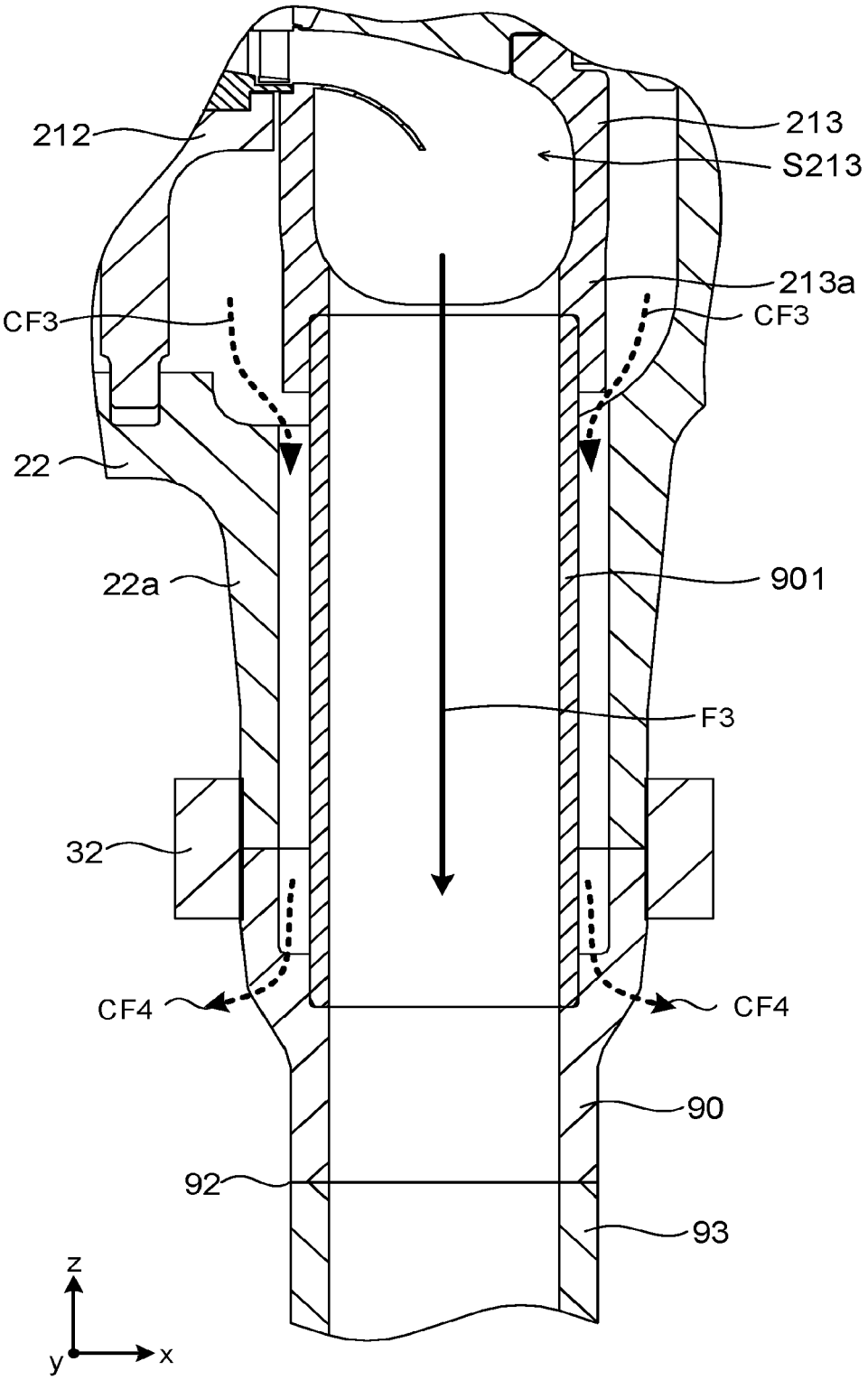
FIG. 4 is a view illustrating a substantial part of a turbine according to a modified embodiment.

A modified embodiment will be exemplified by using FIG. 4. FIG. 4 illustrates a partial cross section of a vertical plane (xz plane), similarly to FIG. 1.

As illustrated in FIG. 4, in the present modified embodiment, the exhaust pipe 90 and the pipe barrel part 22*a* of the outer casing 22 are fastened by using nuts 32 being screws. Concretely, an outer peripheral surface between the exhaust pipe 90 and the pipe barrel part 22*a* of the outer casing 22 includes parts where male screw portions are formed. Further, the nuts 32 formed with female screw portions are attached to the parts where the male screw portions are formed at the outer peripheral surface between the exhaust pipe 90 and the pipe barrel part 22*a* of the outer casing 22. Consequently, the exhaust pipe 90 is fixed to the outer casing 22. Also in the present modified embodiment, it is possible to exhibit an effect such as improvement of reliability over a long period of time, similarly to the case of the above-described embodiments.

Further, although each of the above-described embodiments describes the supercritical $CO_2$ turbine 10 configuring the supercritical $CO_2$ power generation system, the embodiment is not limited to this. It is also possible that, also in each of turbines other than the supercritical $CO_2$ turbine 10 (a steam turbine, a gas turbine, a medium turbine, and so on), a part which functions as an exhaust pipe connecting part (a part corresponding to the pipe barrel part 22*a* of the outer casing 22 in the above description) in a turbine casing and an exhaust pipe are fastened by using screws, similarly to the above. This makes it possible to exhibit operations and effects similar to those of the above-described embodiments. The above-described temperature conditions and pressure conditions of the working media indicate values when the working media contain carbon dioxide ($CO_2$) in a supercritical state as a main component, and can be arbitrarily set in accordance with the working media.

REFERENCE SIGNS LIST

10 . . . supercritical $CO_2$ turbine, 20 . . . turbine casing, 21 . . . inner casing, 22 . . . outer casing, 22*a* . . . pipe barrel part, 23 . . . gland part, 24 . . . packing ring, 25 . . . diffuser, 31 . . . bolt, 32 . . . nut, 40 . . . turbine rotor, 60 . . . turbine stage, 61 . . . stationary blade, 62 . . . rotor blade, 80 . . . combustor casing, 81 . . . bolt, 90 . . . exhaust pipe, 91 . . . welded portion, 92 . . . welded portion, 93 . . . on-site pipe, 211 . . . first inner casing, 212 . . . second inner casing, 213 . . . third inner casing, 213*a* . . . pipe barrel part, 231 . . . first packing head, 232 . . . second packing head, 233 . . . axial seal member, 251 . . . radial seal member, 311 . . . head portion, 312 . . . shaft portion, 801 . . . inlet guide pipe, 802 . . . inlet sleeve, 901 . . . outlet sleeve, AX . . . rotation center axis, CF1, CF2, CF3, CF4 . . . cooling medium, Ds . . . downstream side, F1, F2, F3 . . . working medium, F22 . . . flange, F90 . . . flange, H22 . . . insertion hole, H22*a* . . . hole, H90 . . . insertion hole, R . . . rotational direction, S213 . . . exhaust hood, Us . . . upstream side

What is claimed is:

1. A turbine casing comprising an exhaust pipe connecting part formed of ferritic heat resistant steel, to which an exhaust pipe formed of austenitic heat resistant steel is connected, wherein the exhaust pipe connecting part and the exhaust pipe are fastened by using screws.

2. The turbine casing according to claim 1, wherein:

the screws are bolts;

a flange is formed on at least one of the exhaust pipe connecting part and the exhaust pipe; and the flange is formed with insertion holes into which the bolts are to be inserted.

3. The turbine casing according to claim 1, comprising:

an outer casing to which the exhaust pipe connecting part is provided;

an inner casing disposed inside the outer casing; and an outlet sleeve disposed so as to penetrate the exhaust pipe connecting part, wherein:

the outer casing is formed of the ferritic heat resistant steel;

the inner casing is formed of the austenitic heat resistant steel;

the outlet sleeve is formed of the austenitic heat resistant steel, one end of the outlet sleeve is coupled to the inner casing, and the other end of the outlet sleeve is coupled to the exhaust pipe; and a cooling medium flows through a space interposed between the outer casing and the inner casing, and a cooling medium flows through a space interposed between the exhaust pipe and the outlet sleeve.

4. The turbine casing according to claim 3, wherein the outlet sleeve and the exhaust pipe are integrally formed.

5. The turbine casing according to claim 1, wherein a gas containing $CO_2$ in a supercritical state flows as a working medium.

* * * * *